US005410296A

United States Patent [19]

Montbriand et al.

[11] Patent Number: 5,410,296

[45] Date of Patent: Apr. 25, 1995

[54] MAGNETIC TAG DEACTIVATOR FOR PRE-EXISTING CHECK-OUT COUNTERS

[75] Inventors: David P. Montbriand, Hudson, Wis.; Peter J. Zarembo, Shoreview, Minn.

[73] Assignee: Minnesota Mining and Manufacturing Company, St. Paul, Minn.

[21] Appl. No.: 957,414

[22] Filed: Oct. 6, 1992

[51] Int. Cl.[6] ..... G08B 13/14

[52] U.S. Cl. ..... 340/572; 340/551

[58] Field of Search ..... 340/572, 551; 186/68; 335/205-207, 284

[56] References Cited

U.S. PATENT DOCUMENTS

| | | | |
|---|---|---|---|
| 4,623,877 | 11/1986 | Buckens | 340/572 |
| 4,684,930 | 8/1987 | Minasy et al. | 340/551 |
| 4,692,747 | 9/1987 | Wolf | 340/572 |
| 4,728,938 | 3/1988 | Kaltner | 340/572 |
| 4,870,391 | 9/1989 | Cooper | 340/572 |
| 4,967,185 | 10/1990 | Montean | 340/572 |
| 5,008,649 | 4/1991 | Klein | 340/572 |
| 5,029,291 | 7/1991 | Zhou et al. | 340/551 |
| 5,059,951 | 10/1991 | Kaltner | 340/572 |
| 5,126,720 | 6/1992 | Zhou et al. | 340/572 |
| 5,170,045 | 12/1992 | Bengtsson | 340/572 X |

FOREIGN PATENT DOCUMENTS

446910A1 9/1991 European Pat. Off. .

OTHER PUBLICATIONS

"Demag characteristics of Magnequench TM," Delcoremy Division of General Motors, 2 pgs.

*Primary Examiner*—Brent Swarthout
*Assistant Examiner*—Thomas J. Mullen, Jr.
*Attorney, Agent, or Firm*—Gary L. Griswold; Walter N. Kirn; Eric D. Levinson

[57] ABSTRACT

A magnetic tag deactivator for use in an electromagnetic article surveillance system. [The deactivator is adapted for use in conventional, pre-existing retail store check-out counters.] An elongated magnet assembly is secured beneath a transition plate which spans the distance between a [check-out counter] conveyor belt and countertop of a conventional, pre-existing retail store check-out counter. The magnet assembly provides a magnetic field above the transition plate that is capable of deactivating a magnetically alterable tag secured to an object to be purchased as the object is passed over the transition plate from the conveyor belt to the countertop.

16 Claims, 4 Drawing Sheets

MAGNETIC TAG DEACTIVATOR FOR PRE-EXISTING CHECK-OUT COUNTERS

FIELD OF THE INVENTION

The present invention relates to electromagnetic article surveillance (EAS) systems of the general type in which an alternating magnetic field is produced in an interrogation zone and in which a magnetically responsive tag present in the zone results in the production of a characteristic signal which is detected and processed to create a suitable response, alarm, etc. In particular, the present invention relates to a magnetic tag deactivator which is adapted for use in a retail store check-out counter.

BACKGROUND OF THE INVENTION

Various techniques have been used to detect shoplifting or the unauthorized removal of objects from protected areas. U.S. Pat. No. 4,870,391 (Cooper) discloses the use of target wafers which contain an electrical circuit and are affixed to displayed objects for sale. These targets can be removed only by an authorized person using a special tool. If a patron attempts to take an object for sale out of the store before the sales clerk has removed the target wafer, the wafer's resonant circuit will be detected by a surveillance system as the patron enters an interrogation zone near the store exit, thereby setting off an alarm. The disadvantage of this system is that the sales clerk must physically remove the target wafers from every object that is to be protected, which tends to slow down the check-out process.

U.S. Pat. No. 5,029,291 (Zhou et al.) discloses a method of protecting against shoplifting in a supermarket wherein there is one interrogation zone next to every check-out counter. The patron places the merchandise to be purchased on a conveyor belt on the check-out counter which is outside of the interrogation zone. The patron must, however, push his grocery cart through an interrogation zone located adjacent the check-out counter. This system is disadvantageous in that: (1) it requires a separate interrogation zone for every check-out counter, which could require as many as 20 or more pairs of detection panels for a single store, and (2) it can be difficult to push the cart through the interrogation zone, since the already cramped spacing between adjacent grocery counters is made even more cramped by the addition of a pair of detection panels.

U.S. Pat. No. 4,684,930 (Minasy et al.) discloses the use of a freely rolling cylindrical target deactivator which is mounted in the countertop of the check-out counter. This system is disadvantageous because it requires that the target to be deactivated be placed in contact with the cylindrical deactivator. The use of the roller can slow down the check-out process, particularly if it becomes clogged over time due to repeated use. The system is also disadvantageous because it requires that the countertop of the check-out counter be cut into so as to allow the insertion of the cylindrical deactivator.

U.S. Pat. No. 5,059,951 (Kaltner) discloses the use of a deactivator that is fitted into a bar code scanner located in the countertop of the check-out counter. The deactivator includes a pair of single loop antennas which are fitted to the underside of the scanner cover. The antennas are electrically coupled to a matching circuit, which includes the circuitry necessary to develop and receive appropriate signals to deactivate a label by exposing a resonant circuit contained therein to a relatively high energy field sufficient to cause a short circuit in the resonant circuitry of the marker. A control unit provides the signals used to regulate the antenna system. These signals are conveyed by a cable which extends between a transceiver and a casing in the scanner. This system is disadvantageous because of its complexity. The system is also disadvantageous because successful deactivation of the label is dependent both on the speed with which the label is passed over the deactivator and the distance between the label and the deactivator. Thus, in order to provide appropriate assurance that the label has been deactivated, it is usually necessary to include a verification system that confirms that the label has indeed been deactivated.

It would be desirable to have a simplified deactivator which can be easily adapted to fit existing retail store check-out counters, which may or may not employ countertop bar code scanners.

SUMMARY OF THE INVENTION

Accordingly, the present invention includes a magnetic tag deactivator for use in an electromagnetic article surveillance system. The deactivator is adapted for use in a conventional, pre-existing retail store check-out counter. Such check-out counters typically have a conveyor belt which transports objects to be purchased toward a cashier. Before the objects reach the cashier, they are stopped by a transition plate, where they are left within easy reach of the cashier.

The deactivator of the present invention includes an elongated magnet assembly which is secured beneath the transition plate. The magnet assembly provides a magnetic field above the transition plate that is capable of deactivating a magnetically alterable tag secured to an object as the object is passed over the transition plate. This allows the cashier to easily deactivate the tag as the cashier moves the object from the belt to the countertop.

The intensity and orientation of the magnetic field will be matched to the characteristics of the magnetically alterable tag with which the deactivator is to be used. For example, in a preferred embodiment, such tags can include a magnetizable portion which, when magnetized, changes a detectable characteristic response of the tag, i.e., deactivates it.

BRIEF DESCRIPTION OF THE DRAWING

The present invention will be further understood with reference to the accompanying drawing wherein.

DETAILED DESCRIPTION

Figure 1:
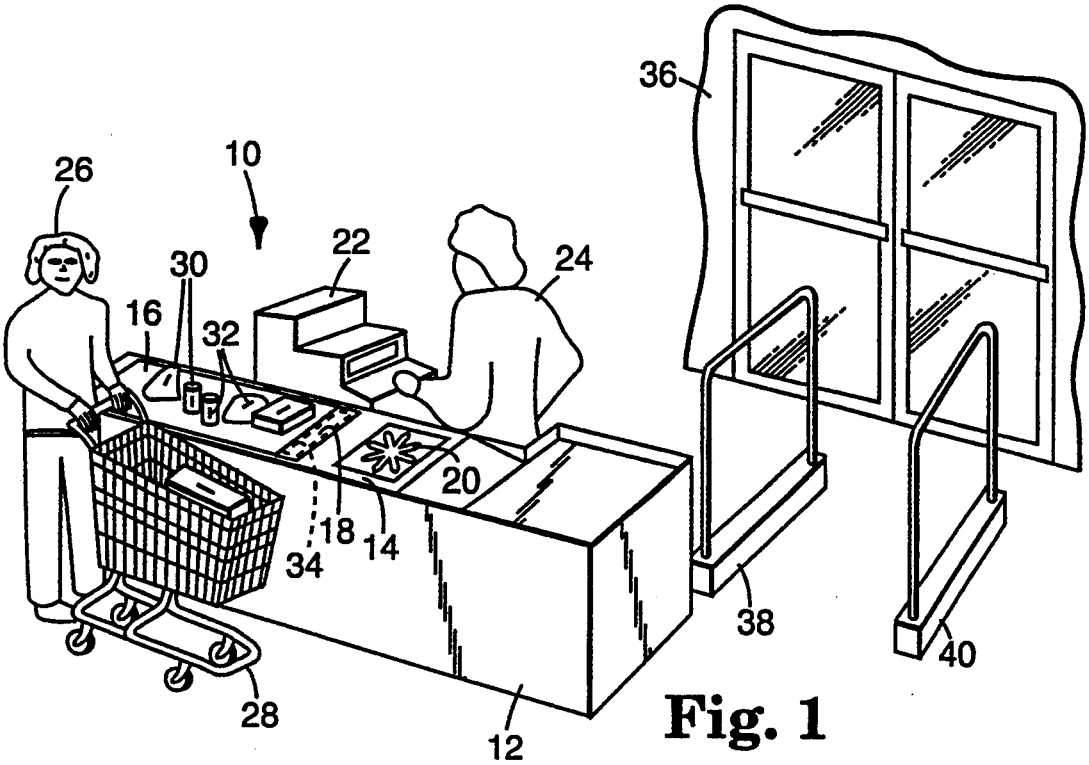
FIG. 1 is a perspective view of a retail store check-out counter using the invention of the present invention.

A typical installation in which the deactivator of the present invention is to be used is shown in FIG. 1. A conventional retail store check-out counter 10 includes a housing 12, a substantially planar countertop 14, a conveyor belt 16, a portion of which is coplanar with the countertop, a transition plate 18, and an optional scanner 20. A customer 26 unloads a shopping cart 28 containing objects 30 by placing the objects on the conveyor belt 16. The objects 30 whose unauthorized removal is to be prevented are provided with magnetically alterable tags 32.

During operation, the conveyor belt 16 conveys the objects 30 to a cashier 24 assigned to cash register 22. The cashier 24 takes objects 30 off the conveyor belt 16 and passes the objects over the transition plate 18 to the countertop 14. An optional sensor 20 in the countertop 14 automatically records the sale of objects to be purchased when they are passed over it in a manner that a bar code on the object can be seen by the sensor. In the alternative, the sale of the objects may be recorded by a hand-held sensor or by having the cashier 24 manually enter the sale price into the cash register 22.

The magnetic tags 32 secured to the objects 30 are magnetized and thereby deactivated by a magnet assembly 34 secured to and beneath the transition plate 18. When the customer 26 completes the purchase, the customer may leave the store through exit doors 36 with his shopping cart 28 containing purchased objects 30, having deactivated magnetic tags 32 secured thereto, by first passing between spaced apart detection panels 38 and 40. However, a person who attempts to take the objects 30 bearing the magnetic tags 32 from the store without having them registered by the cashier 24, and therefore without having the magnetic tags deactivated, will activate an alarm (not shown) as the person carries the objects between the detection panels 38 and 40 in order to pass through the exit doors 36.

The magnetic tag 32 is typically constructed of an elongated strip of a high permeability, low coercive force ferromagnetic material such as permalloy, certain amorphous alloys, or the like. The strip is further provided with a plurality of high coercive force magnetizable sections. These sections are typically formed of a material such as vicalloy, arnochrome, silicon steel or the like, typically having a coercive force in the range of 50 to 240 oersteds. When such sections are magnetized, the residual fields provided thereby magnetically bias the low-coercive-force strip and substantially alter the signal response produced in the presence of an interrogating field. The magnetization of the high-coercive force magnetizable sections is effected upon passing through the fields provided by the magnet assembly 34 when those sections are brought into close proximity with the transition plate 18.

Preferred magnetic tags 32 include WH-0117 Whispertape TM rectangular markers and QTN Quadratag TM markers, sold by 3M Company, St. Paul, Minn., which have high coercive force magnetizable sections of 179 and 81 oersteds, respectively. Other preferred magnetic tags 32 include those disclosed in U.S. Pat. No. 4,967,185 (Montean). The magnetic tags 32 are preferably placed next to or on top of the bar code, or other pricing information, on the objects 30.

As the cashier 24 passes the object 30 to be purchased over the transition plate 18 to the sensor 20, the cashier would ordinarily rotate the object so that its bar code is close to and faces the sensor. All that is required of the cashier 24 to deactivate the tag 32 is that the object 30 be rotated before the bar code, and therefore the tag, has passed over the transition plate 18, so that the tag will be deactivated by the magnetic assembly 34 beneath the transition plate. This may be done so easily by the cashier 24 that the customer 26 may not even notice that the tags 32 are being deactivated by the cashier.

Figure 2:
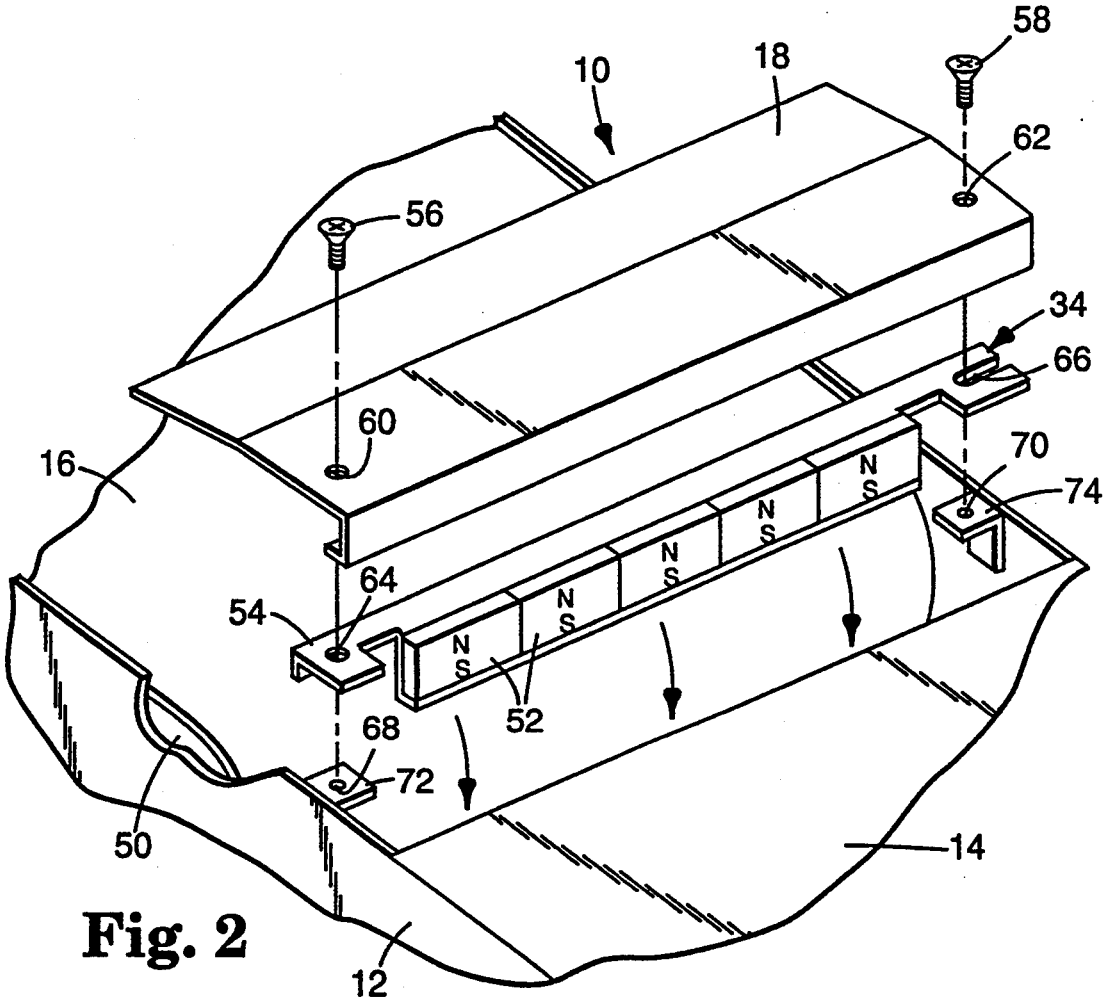
FIG. 2 is an exploded view of a magnet assembly according to one embodiment of the present invention.

An exploded view of the magnet assembly 34 and its relation to the transition plate 18 in the conventional check-out counter 10 is shown in FIG. 2. The transition plate 18 is an elongated, non-magnetic plate, the length of which spans the width of the conveyor belt 16. The transition plate 18 is about 5 to 10 cm wide and is about 56 cm long. The purpose of the transition plate 18 is to span the space between the conveyor belt 16 and the countertop 14 which results from the fact that the conveyor belt is a continuous loop which passes downward around a roller 50 from the plane of the countertop 14 into the housing 12 of the check-out counter 10.

The magnet assembly 34 is configured to fit under the transition plate 18 in the space bounded by the transition plate; the conveyor belt 16 as it passes around the roller 50, and the countertop 14. The roller 50 has a diameter of about 15 cm. The magnet assembly 34 is secured in place by inserting a screw 56 through a hole 60 in the transition plate 18. The screw 56 then passes through a hole 64 in the frame 54 and finally screws into a hole 68 in a bracket 72, which is secured to the housing 12 of the check-out counter 10. Similarly, a second screw 58 is inserted through a second hole 62 in the transition plate 18. The second screw 58 then passes through a slot 66 in the frame 54 and finally screws into a hole 70 in a second bracket 74, which is secured to the housing 12 of the check-out counter 10.

The magnet assembly 34 includes a row of elongated magnets 52. The magnets 52 have dimensions of 2.0 inches long by 0.225 inches wide by 0.675 inches deep (51 by 6 by 17 mm). The magnets 52 are secured to the frame 54 so that their lengths lie parallel to the length of the transition plate 18, their widths are parallel to the width of the transition plate, and their depths extend vertically into the housing 12 of the check-out counter. The lengths of the magnet assembly 34 and the frame 54 extend along substantially the entire length of the transition plate 18. The total lengths for the sum of the magnets 52 in the magnet assembly 34 are preferably 10, 14, 18, and 22 inches (25.4, 35.6, 45.7, and 55.9 cm), corresponding to a row of 5, 7, 9, and 11 two-inch magnets, respectively. The length of the row of magnets 52 should be about as long as the sensor 20 is wide. In other words, the row of magnets 52 should be long enough that the magnetic tags 32 secured to the objects 30 will be assured of passing over the magnets as they pass over the transition plate 18.

The magnets 52 are preferably neodynium-iron-boron magnets having a magnetic energy product of about 7–9 Megagauss-Oersteds. One such magnet is Magnequench TM I, available from Dexter Permag, Dexter Magnetic Materials Division, Chanhassen, Minn.

The magnets 52 are preferably oriented in the magnet assembly 34 so that their magnetization is in a vertical direction resulting in a north-south pole configuration, as shown in FIG. 2. In such a configuration, the magnets provide a substantial magnetic field parallel to the direction of travel of the objects 30 being moved over the width of the transition plate 18. However, other north-south pole configurations are possible, such as having the poles aligned parallel to the direction of travel of the objects 30 being moved over the width of the transition plate 18, so long as the magnetic field provided thereby has a substantial component in that direction. The intensity and orientation of the magnetic field provided by the magnet assembly 34 should be matched to the characteristics of the magnetically alterable tag 32 with which the deactivator is to be used. The strength of the magnetic field provided by the magnet assembly 34 can range from about 900 gauss at the upper surface of the transition plate 18 to about 140 gauss at a height of ½" (1.3 cm) above the plate, to about 85 gauss at a height of about ¾" (1.9 cm) above the plate.

The individual magnets 52 need not be two inches (5.1 cm) in length. For example, twice as many one inch (2.5 cm) magnets or one long magnet could be used in their place. However, the magnet assembly 34 must be able to provide a magnetic field above the transition plate 18 that is strong enough to magnetize and thereby deactivate the magnetic tags 32 which are passed over the plate. Preferably, the magnetic field provided by the magnet assembly 34 above the transition plate 18 is strong enough to deactivate a magnetic tag 32 which is passed over the transition plate at a height of up to about ½" (1.3 cm), and preferably up to about ¾" (1.9 cm) above the plate. If the magnet assembly 34 generates a magnetic field that cannot deactivate the magnetic tag 32 at a height of about ½" (1.3 cm), then there is a danger that the tag will not be deactivated as it is passed over the transition plate 18. And if the magnetic field provided by the magnet assembly 34 is too strong, there is a risk that the objects 30 to be purchased will be drawn down to the transition plate if the objects are made of magnetically susceptible, i.e., ferrous, materials, such as steel. Such a strong attraction between the object 30 and the magnet assembly 34 beneath the transition plate 18 would slow down the check-out process.

Figure 3:
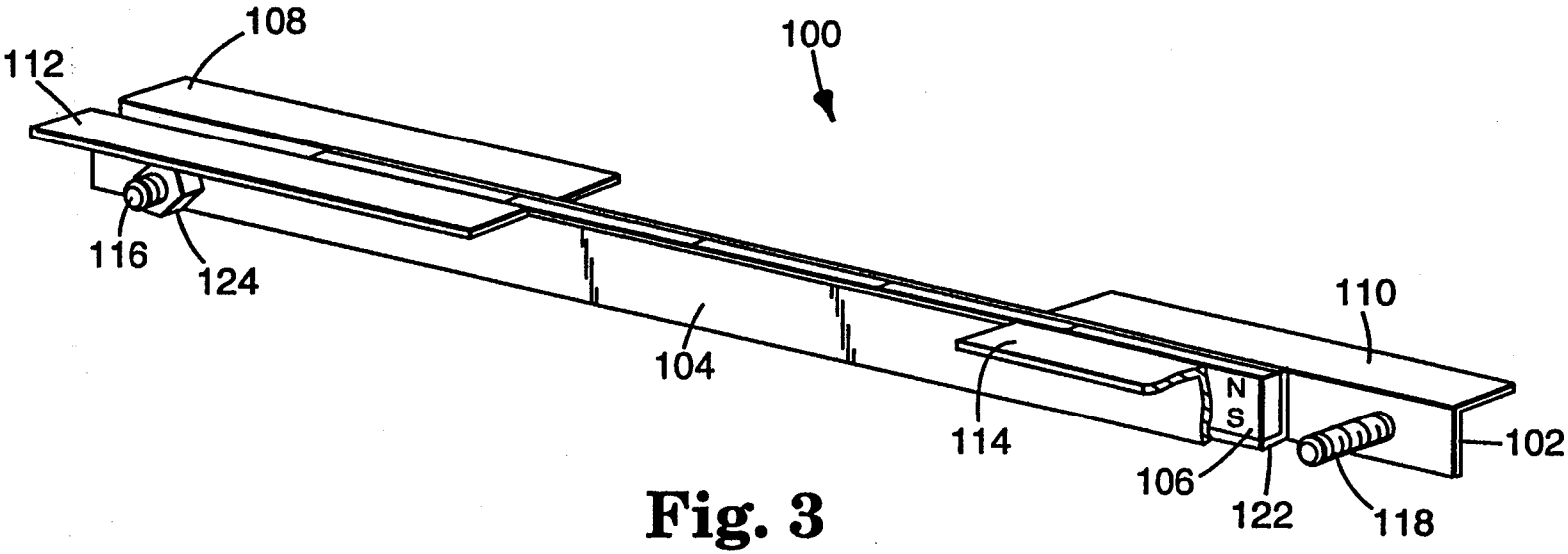
FIG. 3 is a perspective view of a magnet assembly according to another embodiment of the present invention.

An alternative embodiment of the magnet assembly 34 is shown as magnet assembly 100 in FIG. 3. The magnet assembly 100 is comprised of two elongated frames 102 and 104, an elongated frame 122 having a J-shaped cross-section, and a plurality of magnets 106 in a row. The magnets 106 can be the same as the magnets 52. The magnets 106 are secured to the J-shaped frame 122. The J-shaped frame 122 is desirable because it helps to prevent the magnet assembly 100 from being bent in a direction perpendicular to the length of the assembly.

The J-shaped frame 122 and the magnets 106 are then sandwiched between frames 102 and 104, which are attached to each other by bolts 116 and 118, and a first nut 124 and a second nut (not shown), respectively. The frames 102 and 104 each have two perpendicular flanges, 108 and 110, and 112 and 114, respectively. The flanges 108, 110, 112, and 114 can be adhered to the underside of the transition plate 18 by an adhesive, such as a double-sided pressure sensitive adhesive.

The magnet assembly 100 is designed to maintain its adherence to the transition plate 18 even if the transition plate is twisted along its length. Such twisting can occur during installation of the transition plate 18, with the magnet assembly secured thereto, into the housing 12 of the check-out counter 14.

Figure 4A:
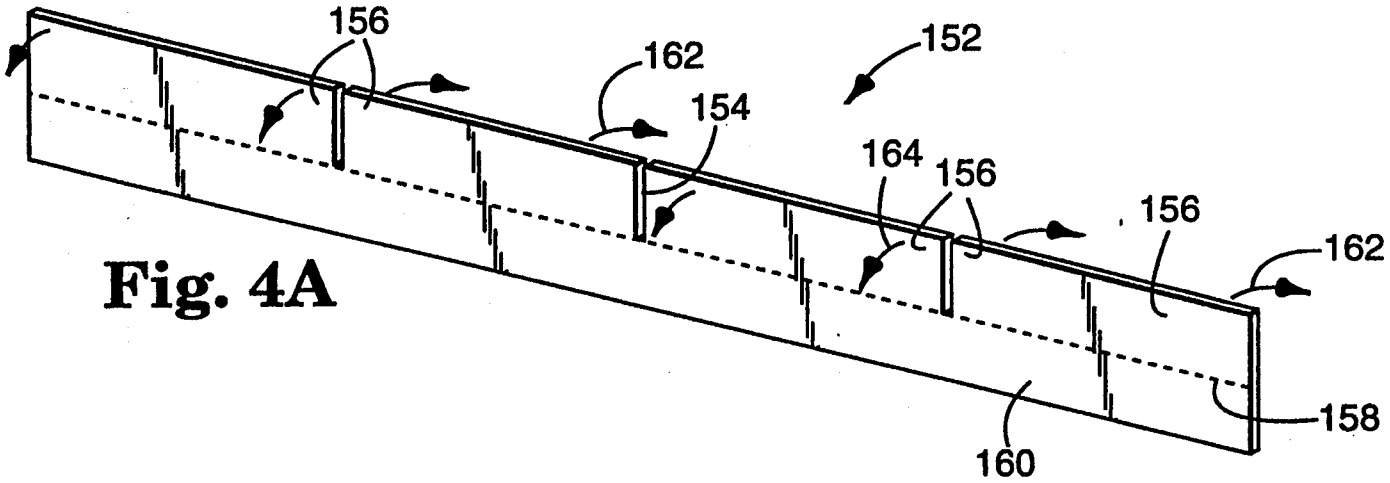
FIG. 4A is a perspective view of a frame for a magnet assembly according to yet another embodiment of the present invention.
Figure 4B:
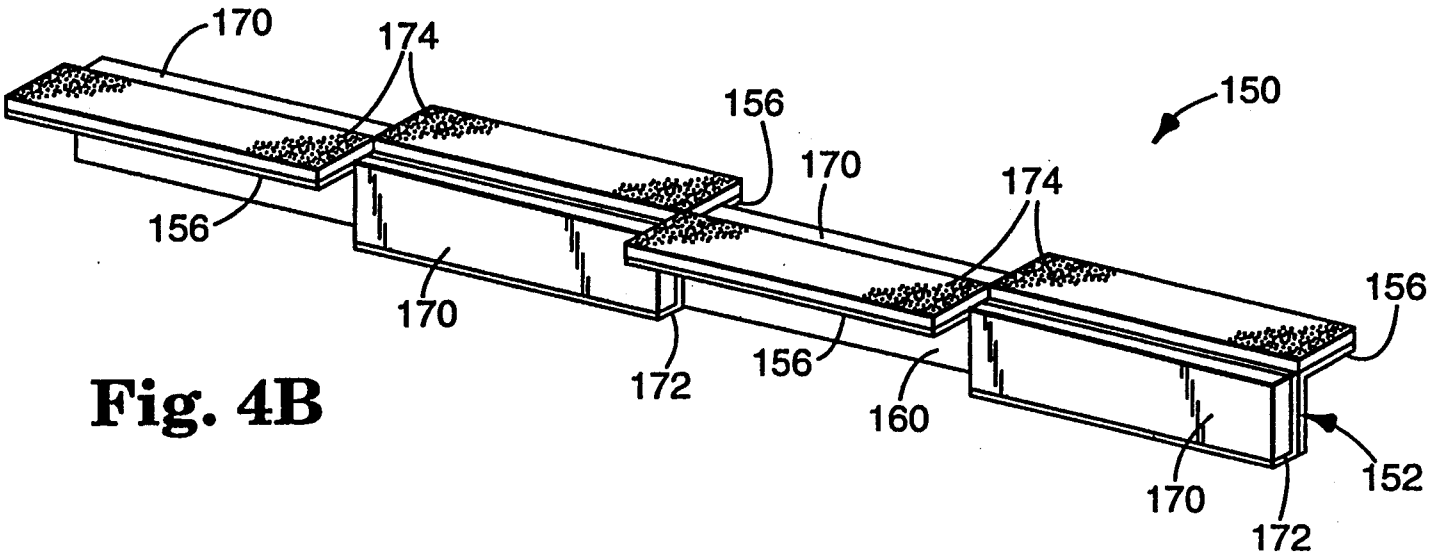
FIG. 4B is a perspective view of one embodiment of the present invention using the frame shown in FIG. 4A.

Another embodiment of the magnetic assembly 34 is shown as a magnet assembly 150 in FIG. 4B. The magnet assembly 150 includes a frame 152. The frame 152 can be formed by taking an elongated metal plate that is about 1 inch (2.5 cm) wide and 16 inches (40.6 cm) long and cutting ½ inch (1.3 cm) long slots 154 every four inches, as shown in FIG. 4A. The slots 154 create flanges 156, which are then folded along a dotted line 158 so that the flanges are perpendicular to an uncut portion 160 of the frame 152. The flanges 156 are folded alternately to one side of the uncut portion 152 or the other, as indicated by the arrows 162 and 164 in FIG. 4A.

Once the frame 152 has been thus formed, magnets 170 may be affixed to the frame by first adhering the magnets to elongated brackets 172 which have a J-shaped cross-section perpendicular to their length. The magnets 170 can be the same as the magnets 52. The brackets 172 having the magnets 170 adhered thereto are then affixed to the uncut portion 160 of the frame 152 on alternating sides of the frame, as shown in FIG. 4B. The magnet assembly 150 can be secured to the underside of the transition plate 18 by adhering the flanges 156 to the underside of the transition plate. This can be accomplished, for example, by the use of double-sided pressure sensitive adhesive pads 174. The number of the pads 174 is preferably equal to the number of the magnets 170. Like the magnet assembly 100, the magnet assembly 150 is also designed to maintain its adherence to the transition plate 18 even if the transition plate is twisted along its length.

Figure 5:
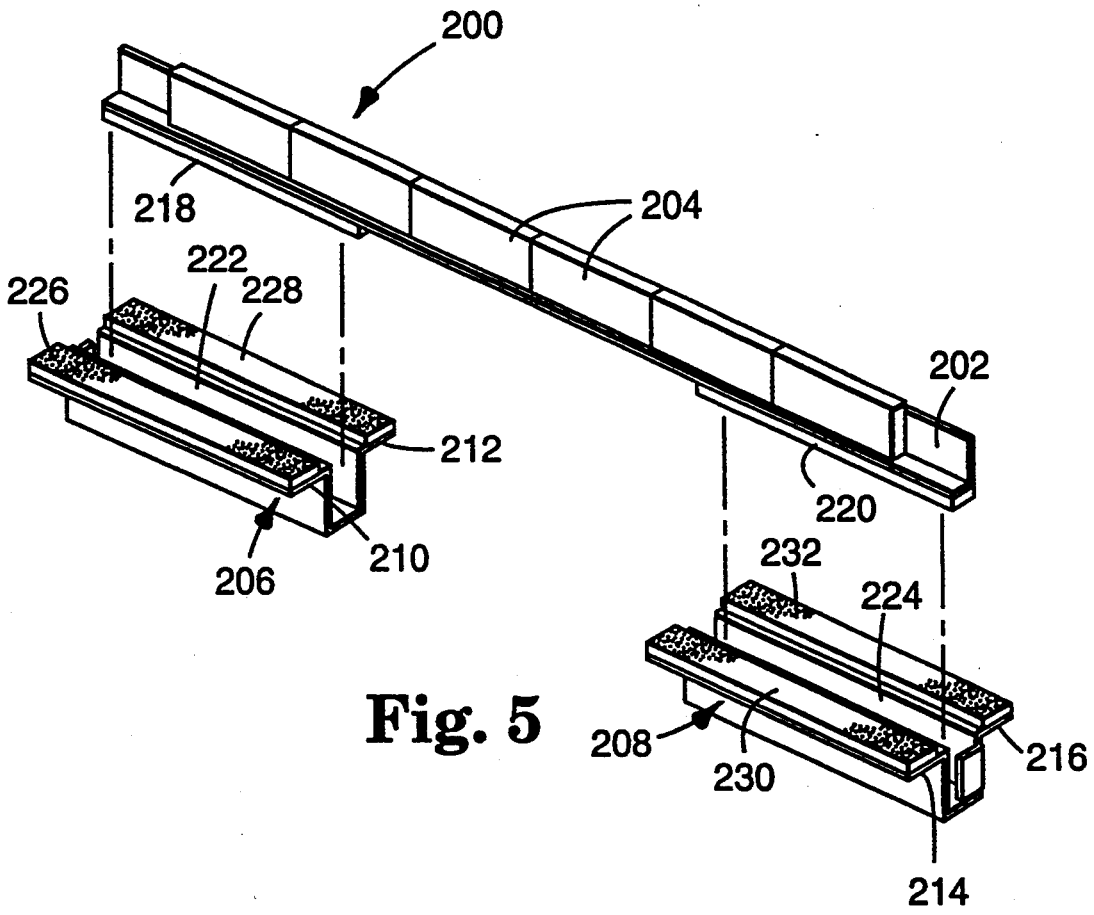
FIG. 5 is an exploded view of a magnet assembly according to still yet another embodiment of the present invention.

A different embodiment of the magnet assembly 34 is shown as a magnet assembly 200 in FIG. 5. The magnet assembly 200 includes an elongated frame 202 having a J-shaped cross section perpendicular to its length, magnets 204, and brackets 206 and 208. The magnets 204 can be the same as the magnets 52 and are secured to the frame 202. The brackets 206 and 208 each include two perpendicular flanges, 210 and 212, and 214 and 216, respectively.

The magnet assembly 200 is assembled by lowering the frame 202, having the magnets 204 secured thereto, into the recesses 222 and 224 in the brackets 206 and 208, respectively. The frame 202 is adhered to the brackets 206 and 208 with soft, low density, foam, double-sided pressure sensitive adhesives 218 and 220.

The magnet assembly 200 can be secured to the underside of the transition plate 18 by adhering the flanges 210, 212, 214, and 216 to the underside of the transition plate. This can be accomplished, for example, by the use of double-sided pressure sensitive adhesive pads 226, 228, 230, and 232. The tops of the pads 226, 228, 230, and 232 should be coplanar with the tops of the magnets 202. The magnet assembly 200 is designed to allow the brackets 206 and 208 to move in three-dimensions while holding the magnets 202 firmly against the transition plate 18.

The magnet assemblies of the present invention can be easily installed in most conventional, pre-existing retail store check-out counters, including supermarket check-out counters. If the existing transition plate is non-magnetic, then a magnet assembly according to the present invention can be installed by unscrewing the existing transition plate, attaching the magnet assembly to the underside of the transition plate, and screwing the transition plate back to the check-out counter. If the existing transition plate is magnetic, then that transition plate should be replaced with a non-magnetic plate.

Some transition plates currently installed in conventional, pre-existing check-out counters can be folded against themselves along a line parallel to their length. In these cases, the transition plate should be replaced with a non-folding, non-magnetic transition plate for use with the present invention.

The magnet assemblies of the present invention are also advantageous in that they require no complicated circuitry, no power source, and they never wear out. Furthermore, the magnet assemblies will deactivate a magnetic tag moved across the transition plate less than ½" (1.3 cm) above the plate regardless of how fast the tag is moved over the plate.

We claim:

1. A magnetic tag deactivator for use in an electromagnetic article surveillance system, wherein the deactivator is included in a conventional, pre-existing retail store check-out counter including a countertop and a conveyor belt for transporting objects toward the countertop, the belt passing around a roller spaced a short distance from the counter so as to leave a space between the belt and the countertop, the belt having a width parallel to the length of the roller, wherein the deactivator includes:

a conventional check-out counter transition plate for allowing objects on the conveyor belt to be readily moved across the transition plate onto the countertop, the transition plate being positioned between the conveyor belt and the countertop, the transition plate having a length spanning the width of the belt and having a width, perpendicular to its length, spanning the space between the belt and the countertop; and an elongated magnet assembly secured to a bottom surface of the transition plate, the magnet assembly having a length extending substantially along the length of the transition plate, wherein the magnet assembly provides a magnetic field above the transition plate which is used to deactivate a magnetic tag secured to an object on the conveyor belt as the object is passed over the transition plate to the countertop;

wherein the deactivator is installed in the check-out counter.

2. The deactivator of claim 1, wherein the magnet assembly includes a row of elongated magnets, the lengths of which exceed their widths, wherein their lengths are parallel to the length of the transition plate.

3. The deactivator of claim 2, wherein the magnets are oriented so that their widths are parallel to the width of the transition plate, wherein the magnets have widths of about 6 mm and a depth perpendicular to their lengths and widths of about 17 mm.

4. The deactivator of claim 1, wherein the magnetic field above the transition plate is used to deactivate the tag as it is passed over the transition plate in a direction perpendicular to the length of the transition plate at a height of less than about 1.3 cm.

5. The deactivator of claim 1, wherein the magnet assembly includes at least one elongated magnet secured to an elongated frame, the length of the frame extending substantially along the length of the transition plate.

6. The deactivator of claim 5, wherein the transition plate is configured to receive at least one screw at each end of its length, and wherein the frame is secured to the transition plate by at least two screws.

7. The deactivator of claim 5, wherein the frame is secured to the transition plate by an adhesive.

8. The deactivator of claim 7, wherein the adhesive is a pressure sensitive adhesive.

9. The deactivator of claim 5, wherein the frame has a cross-section perpendicular to its length that is J-shaped, whereby the magnet assembly is resistant to being bent in a direction perpendicular to its length.

10. A method of installing a magnetic tag deactivator into a conventional, pre-existing retail store check-out counter including a countertop, transition plate, and a conveyor belt for transporting objects to be purchased toward the countertop, the belt passing around a roller spaced a short distance from the counter so as to leave a space between the belt and the countertop, the belt having a width parallel to the length of the roller, and wherein the transition plate is positioned to allow objects on the conveyor belt to be readily moved across the transition plate onto the countertop, including the steps of:

removing the transition plate from the pre-existing check-out counter, the transition plate having a length spanning the width of the belt and a width, perpendicular to its length, spanning the space between the belt and the countertop;

securing an elongated magnet assembly to a bottom surface of the removed transition plate or a substitute transition plate of the same size so that the length of the magnet assembly extends substantially along the length of the transition plate; and installing the transition plate having the magnet assembly secured thereto into the pre-existing check-out counter.

11. The method of claim 10, wherein the step of securing the magnet assembly to the transition plate is performed by using a pressure sensitive adhesive.

12. The method of claim 10, wherein the step of securing the magnet assembly to the transition plate is performed by using screws.

13. A magnetic tag deactivator for use in an electromagnetic article surveillance system, wherein the deactivator is included in a conventional, pre-existing retail store check-out counter including a countertop and a conveyor belt for transporting objects toward the countertop, the belt passing around a roller spaced a short distance from the counter so as to leave a space between the belt and the countertop, the belt having a width parallel to the length of the roller, wherein the deactivator includes:

a conventional check-out counter transition plate for allowing objects on the conveyor belt to be readily moved across the transition plate onto the countertop, the transition plate being positioned between the conveyor belt and the countertop, the transition plate having a length spanning the width of the belt and having a width, perpendicular to its length, spanning the space between the belt and the countertop; and an elongated magnet assembly including at least one elongated magnet secured to an elongated frame, the frame having a length extending substantially along the length of the transition plate and secured to a bottom surface thereof, wherein the frame has a cross-section perpendicular to its length that is J-shaped, whereby the magnet assembly is resistant to being bent in a direction perpendicular to its length, and further including a pair of elongated frames having a length substantially equal to the length of the J-shaped frame, wherein the three frames are substantially parallel, and wherein the J-shaped frame is sandwiched between the further pair of frames, wherein the magnet assembly provides a magnetic field above the transition plate which is used to deactivate a magnetic tag secured to an object on the conveyor belt as the object is passed over the transition plate to the countertop;

wherein the deactivator is installed in the check-out counter.

14. The deactivator of claim 13, wherein the further pair of elongated frames is secured to the transition plate by an adhesive.

15. The deactivator of claim 14, wherein the adhesive is a pressure sensitive adhesive.

16. A magnetic tag deactivator for use in an electromagnetic article surveillance system, wherein the deactivator is included in a conventional, pre-existing supermarket check-out counter including a countertop and a conveyor belt for transporting objects toward the countertop, the belt passing around a roller spaced a short distance from the counter so as to leave a space between the belt and the countertop, the belt having a width parallel to the length of the roller, wherein the deactivator includes:

a conventional, non-magnetic, check-out counter transition plate for allowing objects on the conveyor belt to be readily moved across the transition plate onto the countertop, the transition plate being positioned between the conveyor belt and the countertop, the transition plate having a length spanning the width of the belt and having a width, perpendicular to its length, spanning the space between the belt and the countertop; and an elongated magnet assembly secured to a bottom surface of the transition plate, the magnet assembly having a length extending substantially along the length of the transition plate, wherein the magnet assembly provides a magnetic field above the transition plate which is used to deactivate a magnetic tag secured to an object on the conveyor belt as the object is passed over the transition plate to the countertop;

wherein the deactivator is installed in the check-out counter.

* * * * *

UNITED STATES PATENT AND TRADEMARK OFFICE

CERTIFICATE OF CORRECTION

PATENT NO.: 5,410,296

DATED: April 25, 1995

INVENTOR(S): Montbriand et al.

It is certified that error appears in the above-identified patent and that said Letters Patent is hereby corrected as shown below:

On the title page:

In the Abstract, lines 2-4, please delete "[The deactivator is adapted for use in conventional, pre-existing retail store check-out counters.]".

In the Abstract, line 6, please delete "[check-out counter]".

Signed and Sealed this

Twelfth Day of December, 1995

*Attest:*

Bruce Lehman

BRUCE LEHMAN

*Attesting Officer*

*Commissioner of Patents and Trademarks*